US012768611B2

(12) United States Patent
Cai

(10) Patent No.: US 12,768,611 B2
(45) Date of Patent: Oct. 20, 2026

(54) WATER GUN

(71) Applicant: Da Cai, Shantou (CN)

(72) Inventor: Da Cai, Shantou (CN)

( * ) Notice: Subject to any disclaimer, the term of this patent is extended or adjusted under 35 U.S.C. 154(b) by 0 days.

(21) Appl. No.: 19/532,392

(22) Filed: Feb. 6, 2026

(65) Prior Publication Data

US 2026/0168757 A1 Jun. 18, 2026

(30) Foreign Application Priority Data

Jan. 19, 2026 (CN) ..... 202620068652.7

(51) Int. Cl.
*F41B 9/00* (2006.01)

(52) U.S. Cl.
CPC ..... *F41B 9/0065* (2013.01); *F41B 9/00* (2013.01); *F41B 9/0081* (2013.01)

(58) Field of Classification Search
CPC ..... F41B 9/00; F41B 9/0065
USPC ..... 124/53.5; 222/79
See application file for complete search history.

(56) References Cited

U.S. PATENT DOCUMENTS 5,238,149 A * 8/1993 Johnson ..... B05B 9/0816 222/401
6,345,732 B1 * 2/2002 Zimmerman ..... F41B 9/0065 222/79
7,913,880 B2 * 3/2011 Chia ..... A63H 23/10 222/386
11,965,707 B1 * 4/2024 Helinski ..... F41B 9/0075
2016/0341515 A1 * 11/2016 Liang ..... F41B 9/004
2019/0113301 A1 * 4/2019 Ma ..... F41B 9/004
2020/0080816 A1 3/2020 Walter
2025/0283687 A1 * 9/2025 She ..... F41B 9/0031

FOREIGN PATENT DOCUMENTS

AU 2021 104966 * 9/2021 ..... F41A 9/63

* cited by examiner

*Primary Examiner* — John E Simms, Jr.

(57) ABSTRACT

A water gun is provided. On the water gun, when a first mating position and a second mating position are in alignment fit, a plug-in member is detachably plugged into a plug-in hole, so that a reset clamping member is movably clamped to the plug-in member, thus achieving quick assembling and disassembling of a storage device and a gun body, and enhancing disassembling convenience. Furthermore, when the first mating position and the second mating position are in alignment fit, a first conductive component and a second conductive component are also in detachable fit, so that an electrical element or a power source on the storage device can be mated and electrically connected with a circuit on the gun body, thus eliminating an additional circuit mating and assembling step and further simplifying an assembling process.

9 Claims, 12 Drawing Sheets

WATER GUN

TECHNICAL FIELD

The present disclosure relates to the field of toys, and in particular, to a water gun.

BACKGROUND

An existing water gun typically includes a gun body and a container for accommodating an object to be shot. During use, the object to be shot is supplied from the container to the gun body and is then shot by the gun body. However, the existing water gun still has shortcomings:

First, some water guns include electrical elements disposed on the container for storing the object to be shot. An electrical element is typically electrically connected to a power source inside the gun body by using a fixed circuit, making it difficult to remove the container from the gun body and causing poor container-disassembling convenience.

Second, after the container is removed, it is difficult to quickly align and assemble the container with the gun body. In addition, before assembling, the electrical element on the container and a power supply circuit inside the gun body also need to be additionally mated and assembled, so that the assembling is cumbersome.

SUMMARY

The present disclosure provides a water gun, which can solve problems of poor disassembling convenience and cumbersome assembling.

The present disclosure provides a water gun, including:

a gun body provided with a first mating position;

a shooting device having a receiving end and a shooting end, where the shooting device is arranged on the gun body; the shooting end is exposed from a surface of the gun body and is communicated with the receiving end; the receiving end is exposed within the first mating position;

a storage device having a storage cavity, a second mating position, and an output end, where the output end is exposed within the second mating position and is communicated with the storage cavity;

a mating device including a plug-in member, a plug-in hole, and a reset clamping member, where one of the plug-in member and the plug-in hole is arranged at the first mating position, and the other one of the plug-in member and the plug-in hole is arranged at the second mating position; the reset clamping member is movably disposed within the plug-in hole; and a conductive device including a first conductive component and a second conductive component, where the first conductive component is disposed within the first mating position, and the second conductive component is disposed within the second mating position;

when the first mating position and the second mating position are in alignment fit, the first conductive component and the second conductive component are in detachable fit and are communicated with each other; and the plug-in member is detachably plugged into the plug-in hole, so that the reset clamping member is movably clamped to the plug-in member, thereby electrically connecting the output end with the receiving end.

Preferably, the reset clamping member includes a reset member and an elastic member; the reset member is slidably disposed within the plug-in hole; the elastic member is in driving connection with the reset member; and the reset member is configured to provide a force for driving the reset member to do reset sliding, so that the reset member is movably clamped to the plug-in member.

Preferably, the plug-in hole is located inside the first mating position, and the plug-in member is fixedly disposed within the second mating position;

the reset member is slidably mounted on the gun body; a snap-fit portion is arranged on the reset member; a snap-in slot is formed in the plug-in member; and the snap-fit portion is configured to be detachably plugged into the snap-in slot under driving of the reset member.

Preferably, a clearance hole is further formed in the gun body; and an end portion of the reset member is arranged to pass through the clearance hole and is exposed from an outer surface of the gun body.

Preferably, the first conductive component includes a conductive plug; the second conductive component includes a conductive socket; and the conductive plug is in detachable plug-in fit with the conductive socket.

Preferably, the first conductive component includes a conductive socket; the second conductive component includes a conductive plug; and the conductive plug is in detachable plug-in fit with the conductive socket.

Preferably, a plug-in slot is formed in the first mating position; the first conductive component is disposed within the plug-in slot; and the second conductive component is detachably plugged into the plug-in slot.

Preferably, the storage device includes a storage member, a fixed ring, and a power source; the storage cavity is provided on the storage member; the fixed ring is arranged on the storage member; the second mating position is arranged on the fixed ring; and the power source is electrically connected to the second conductive component.

Preferably, the storage device includes a storage member, a fixed ring, and an electrical element; the storage cavity is provided on the storage member; the fixed ring is arranged on the storage member; the second mating position is arranged on the fixed ring; and the electrical element is electrically connected to the second conductive component.

Preferably, the storage member includes an annular water tank; the fixed ring sleeves the annular water tank;

the storage device further includes a liquid output head; the shooting device includes a liquid receiving head; the liquid output head is arranged at the output end, and the liquid receiving head is communicated with the annular water tank; the liquid receiving head is arranged at the shooting end, and the liquid receiving head is communicated with the shooting end; and the liquid output head is configured to be mated and electrically connected with the liquid receiving head under driving of the annular water tank.

Preferably, the electrical element includes two light-emitting elements; each light-emitting element includes a profiled cylindrical shell, a light-emitting circuit board disposed within the profiled cylindrical shell, and a plurality of light-emitting diodes (LEDs) arranged on the light-emitting circuit board; the two profiled cylindrical shells are symmetrically arranged on the annular water tank; and the two light-emitting circuit boards are electrically connected to the second conductive components.

Preferably, at least one profiled slot is formed in the storage member; each profiled slot is configured to accommodate the electrical element; and an appearance contour of the electrical element matches a contour of a slot wall of each profiled slot.

Preferably, the mating device further includes a first connector and a second connector slot;

the first connector is arranged on the gun body; an anti-loosening slot is formed in the first connector;

the second connector slot is arranged on the storage device; an anti-loosening protrusion is disposed within the second connector slot; and when the first connector is detachably plugged into the second connector slot, the anti-loosening protrusion is movably clamped into the anti-loosening slot.

The present disclosure has the following beneficial effects:

A water gun is provided. On the water gun, when a first mating position and a second mating position are in alignment fit, a plug-in member is detachably plugged into a plug-in hole, so that a reset clamping member is movably clamped to the plug-in member, thus achieving quick assembling and disassembling of a storage device and a gun body, and enhancing disassembling convenience.

Furthermore, when the first mating position and the second mating position are in alignment fit, a first conductive component and a second conductive component are also in detachable fit, so that an electrical element or a power source on the storage device can be mated and electrically connected with a circuit on the gun body, thus eliminating an additional circuit mating and assembling step and further simplifying an assembling process.

In addition, when the first mating position and the second mating position are in alignment fit, an output end and a receiving end are also mated and electrically connected with each other, thereby ensuring effective connection between the storage device and the shooting device, that is, an object to be shot inside the storage device can be supplied to a shooting device for shooting through the output end and the receiving end. Thus, while ensuring convenient mounting and removal of the storage device, the object to be shot that is stored inside the storage device can be smoothly delivered to the shooting device, and a shooting function of the water gun is not affected.

BRIEF DESCRIPTION OF THE DRAWINGS

The exemplary implementations of the present disclosure will be described in more details by combining the accompanying drawings. The above and other objectives, features, and advantages of the present disclosure will become more obvious. In the exemplary implementations of the present disclosure, the same reference numerals generally represent the same components.

DETAILED DESCRIPTION OF THE EMBODIMENTS

Figure 1:
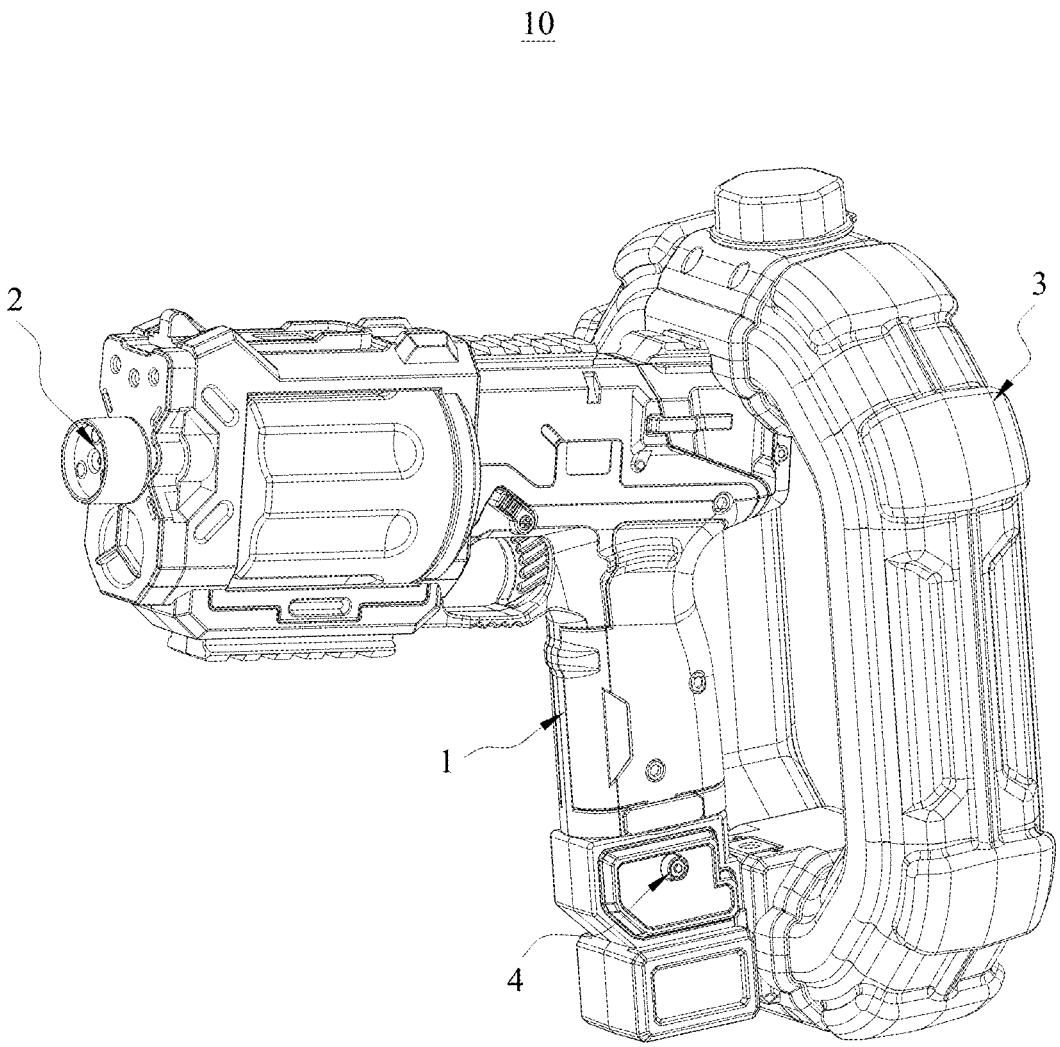
FIG. 1 is a schematic diagram of a structure of a water gun in some embodiments of the present disclosure.

The implementations of the present disclosure will be described in more details below with reference to the accompanying drawings. Although the accompanying drawings show the exemplary implementations of the present disclosure, it should be understood that the present disclosure can be implemented in various forms, and should not be limited to the implementations stated herein. Rather, these implementations are provided for understanding the present disclosure more thoroughly and completely, and can completely transfer the scope of the present disclosure to those skilled in the art.

It should be understood that although various information may be described using terms such as "first", "second", and "third" in the present disclosure, such information should not be limited to these terms. These terms are only used to distinguish information of the same type from each other. For example, without departing from the scope of the present disclosure, the first information can also be referred to as the second information, and similarly, the second information can also be referred to as the first information. Thus, features defined as "first" and "second" explicitly or implicitly include one or more of the features. In the description of the present disclosure, "plurality" means two or more, unless otherwise expressly and specifically defined.

In the descriptions of the present disclosure, it should be understood that orientations or positional relationships indicated by the terms "length", "width', "upper", "lower", "front", "rear", "left", "right", "vertical", "horizontal", "top", "bottom", "inner", "outer", and the like are orientations or positional relationships as shown in the drawings, and are only for the purpose of facilitating and simplifying the descriptions of the present disclosure instead of indicating or implying that devices or elements indicated must have particular orientations, and be constructed and operated in the particular orientations, so that these terms are not construed as limiting the present disclosure.

Unless otherwise expressly specified and limited, the terms "mount", "connect", "connection", "fix" the like should be understood in a broad sense, such as, a fixed connection, a detachable connection, an integrated connection, a mechanical connection, an electrical connection, a direct connection, an indirect connection through an intermediate medium, an internal communication of two elements, or interaction between two elements. For those of ordinary skill in the art, the specific meanings of the aforementioned terms in the present disclosure can be understood based on specific conditions.

Figure 2:
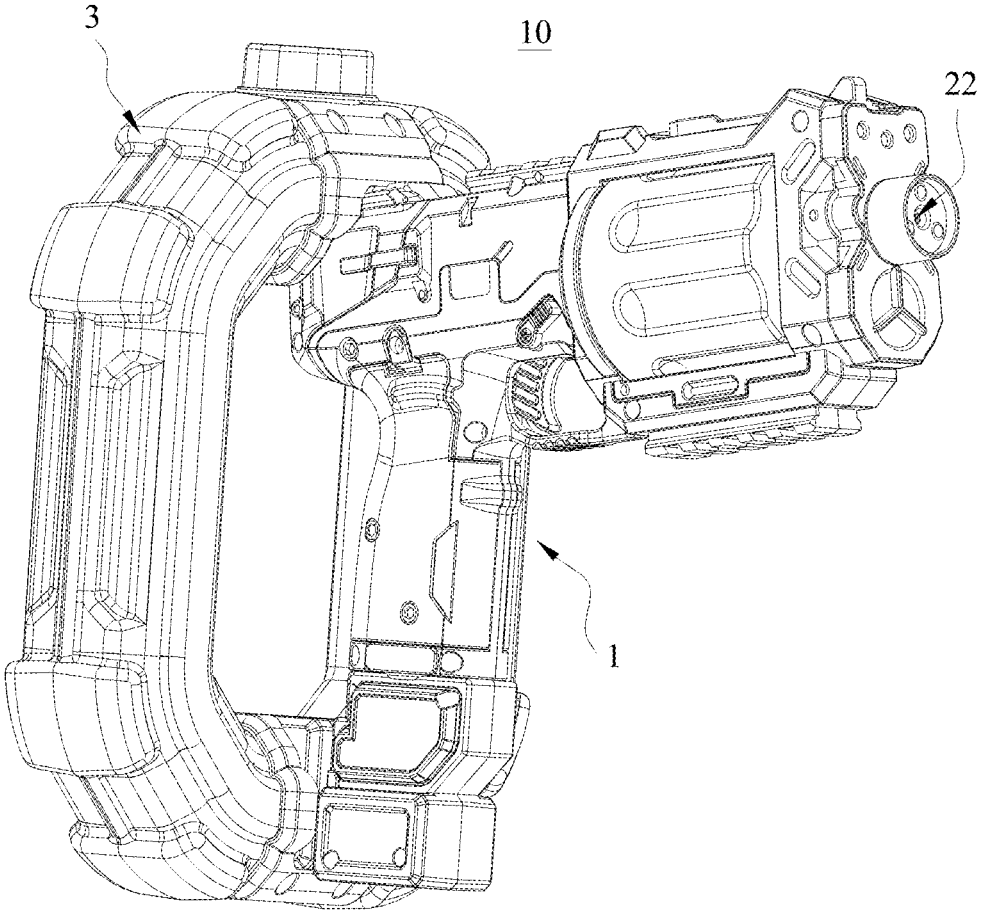
FIG. 2 is a schematic diagram of a structure of the water gun shown in FIG. 1, viewed in another angle.

FIG. 1 and FIG. 2 show a water gun 10 according to some embodiments of the present disclosure, which has a shooting function. During operation, an object to be shot can be endowed with kinetic energy, so that the object to be shot can be shot at an initial velocity.

Figure 3:
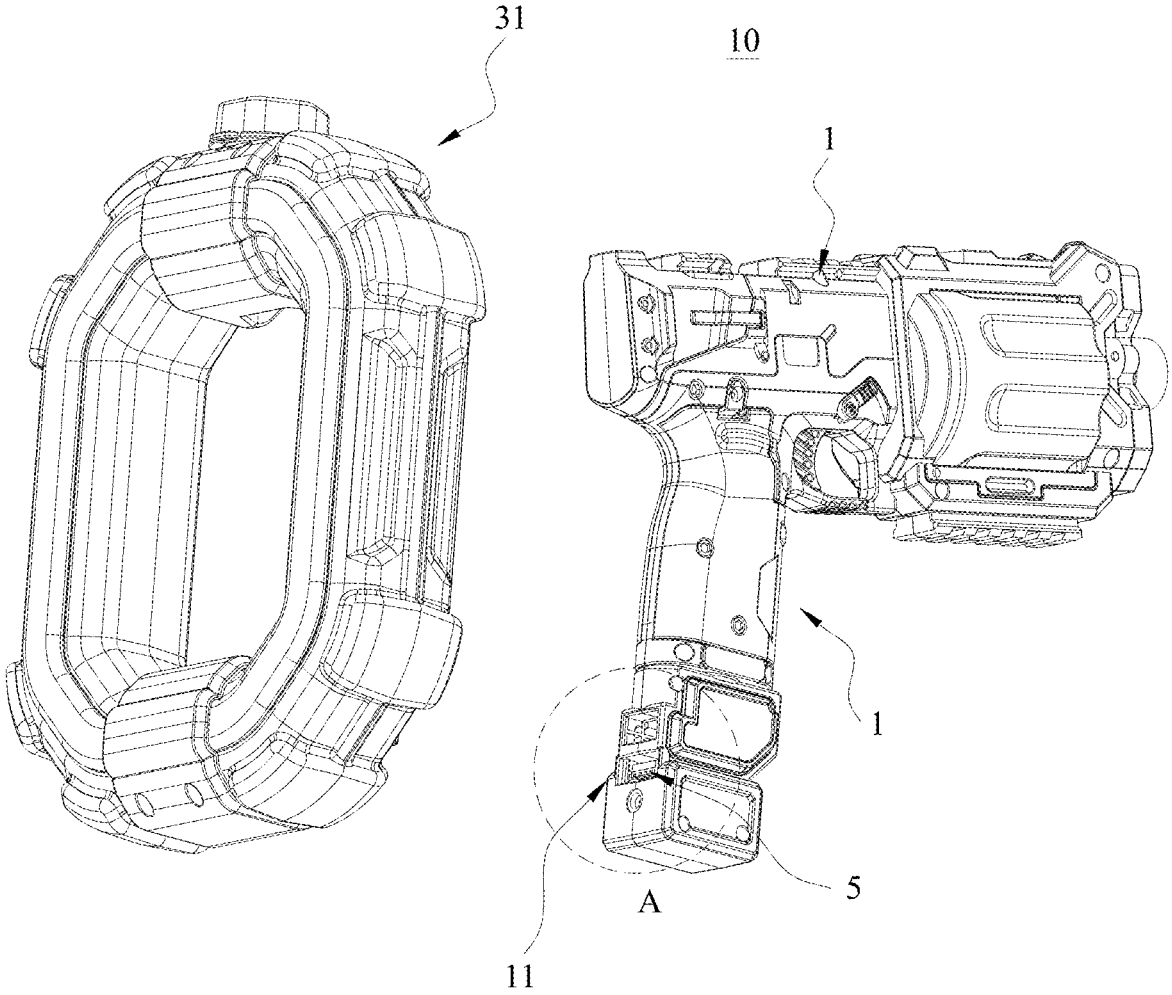
FIG. 3 is an exploded view of a water gun in some embodiments of the present disclosure.

As shown in FIG. 1 to FIG. 3, the water gun 10 includes a gun body 1, a shooting device 2, a storage device 3, a mating device 4, and a conductive device 5.

It should be noted that the gun body 1 is configured to provide mounting positions for other devices or mechanisms. The shooting device 2 is arranged on the gun body 1. The shooting device 2 is configured to supply kinetic energy to the object to be shot during operation, so that the object to be shot has kinetic energy and is then ejected out of the gun body 1 at the initial velocity. The storage device 3 is detachably arranged on the gun body 1. The storage device 3 is configured to store the object to be shot. After the storage device 3 is aligned with and assembled on the gun body 1, the object to be shot can be delivered to the shooting device 2 through the storage device 3 for shooting. The mating device 4 is arranged between the gun body 1 and the storage device 3. The mating device 4 is configured to achieve detachable connection between the gun body 1 and the storage device 3. The conductive device 5 is separately arranged on the gun body 1 and the storage device 3. The conductive device 5 is configured to electrically connect the gun body 1 with the storage device 3 after the gun body 1 is aligned and assembled with the storage device 3.

As shown in FIG. 1 to FIG. 10, the gun body 1 is provided with a first mating position 11.

The shooting device 2 has a receiving end 21 and a shooting end 22. The shooting device 2 is arranged on the gun body 1. The shooting end 22 is exposed from a surface of the gun body 1 and is communicated with the receiving end 21. The receiving end 21 is exposed within the first mating position 11.

The storage device 3 has a storage cavity 312, a second mating position 321, and an output end 322. The output end 322 is exposed within the second mating position 321 and is communicated with the storage cavity 312.

The mating device 4 includes a plug-in member 41, a plug-in hole 42, and a reset clamping member 43. One of the plug-in member 41 and the plug-in hole 42 is arranged at the first mating position 11, and the other one of the plug-in member 41 and the plug-in hole 42 is arranged at the second mating position 321. The reset clamping member 43 is movably disposed within the plug-in hole 42.

The conductive device 5 includes a first conductive component 51 and a second conductive component 52. The first conductive component 51 is disposed within the first mating position 11, and the second conductive component 52 is disposed within the second mating position 321.

When the first mating position 11 and the second mating position 321 are in alignment fit, the first conductive component 51 and the second conductive component 52 are in detachable fit and are communicated with each other; and the plug-in member 41 is detachably plugged into the plug-in hole 42, so that the reset clamping member 43 is movably clamped to the plug-in member 41, thereby electrically connecting the output end 322 with the receiving end 21.

It can be understood that the first mating position 11 arranged on the gun body 1 is configured to achieve precise alignment fit with the second mating position 321 of the storage device 3, so as to provide a position for mating the mating device 4, the conductive device 5, and the shooting device 2 with the storage device 3.

On the shooting device 2, the receiving end 21 is configured to receive an object to be shot supplied by the output end 322 of the storage device 3. The shooting end 22 is configured to shoot the object to be shot that is received by the receiving end 21. The shooting end 22 is configured to be exposed from the surface of the gun body 1, to facilitate the shooting of the object to be shot, thus avoiding structural interference with the shooting of the object to be shot. The receiving end 21 is configured to be exposed within the first mating position 11, so that it is convenient to mate and electrically connect the receiving end 21 with the output end 322 of the storage device 3, thus ensuring that the object to be shot can smoothly enter the shooting device 2.

The storage cavity 312 on the storage device 3 is configured to accommodate and store the object to be shot. The second mating position 321 on the storage device 3 is configured to cooperate with the first mating position 11 on the gun body 1. The output end 322 is configured to discharge the object to be shot that is stored inside the storage cavity 312 to the receiving end 21 of the shooting device 2, to achieve the supplying of the object to be shot.

On the mating device 4, the plug-in member 41 mutually cooperates with the plug-in hole 42. Specifically, when the first mating position 11 is aligned with the second mating position 321, the plug-in member 41 is correspondingly plugged into the plug-in hole 42. Furthermore, the plug-in member 41 is further movably clamped with the reset clamping member 43, thus limiting the position of the plug-in member 41 within the plug-in hole 42, to prevent the plug-in member 41 from being accidentally separated from the plug-in hole 42 and then stably mount the storage device 3 on the gun body 1. When removal is required, the reset clamping member 43 releases clamping on the plug-in member 41 through an external force, so that the limitation on the plug-in member 41 inside the plug-in hole 42 can be released, and the plug-in member 41 can be removed from the plug-in hole 42, to achieve quick separation of the storage device 3 from the gun body 1.

On the conductive device 5, when the first mating position 11 and the second mating position 321 are in alignment fit, the first conductive component 51 and the second conductive component 52 are in detachable fit and are mutually communicated with each other, so that an electrical element or a power source on the storage device 3 can form a connected circuit together with a circuit on the gun body 1. Certainly, after the storage device 3 is separated from the gun body 1, the first conductive component 51 is also separated from the second conductive component 52, so that the electrical element or the power source on the storage device 3 is disconnected from the circuit on the gun body 1.

It should be noted that the shooting device 2 is the existing technology. If the object to be shot is liquid, the shooting device can be configured as a common liquid shooting mechanism in the water gun in the existing technology, and a shape of the storage device 3 can be flexibly set. A surface contour of the first mating position 11 is preferably configured to match a surface contour of the second mating position 321, so that when the first mating position 11 and the second mating position 321 are in alignment fit, formation of an excessively large fit clearance between the first mating position 11 and the second mating position 321 can be avoided, and tightness of fit between the gun body 1 and the storage device 3 after assembling is enhanced. The plug-in member 41 and the plug-in hole 42 can be configured to match each other in contour, thus providing precise axial positioning for the mating between the storage device 3 and the gun body 1.

In summary, in this embodiment of the present disclosure, quick assembling and disassembling of the storage device 3 and the gun body 1 are achieved by the fit of the plug-in member 41, the plug-in hole 42, and the reset clamping member 43 of the mating device 4, thereby enhancing disassembling convenience. By virtue of the mating and electrical connection between the first conductive component 51 and the second conductive component 52 of the conductive device 5, an assembling process of circuit mating is simplified. Meanwhile, the mating and electrical connection between the output end 322 and the receiving end 21 ensures that the object to be shot inside the storage device 3 can be smoothly delivered to the shooting device 2, thus ensuring a normal shooting function of the water gun 10. While achieving the convenient mounting and removal of the storage device, it also considers the effectiveness of circuit connection and delivery of the object to be shot.

Figure 10:
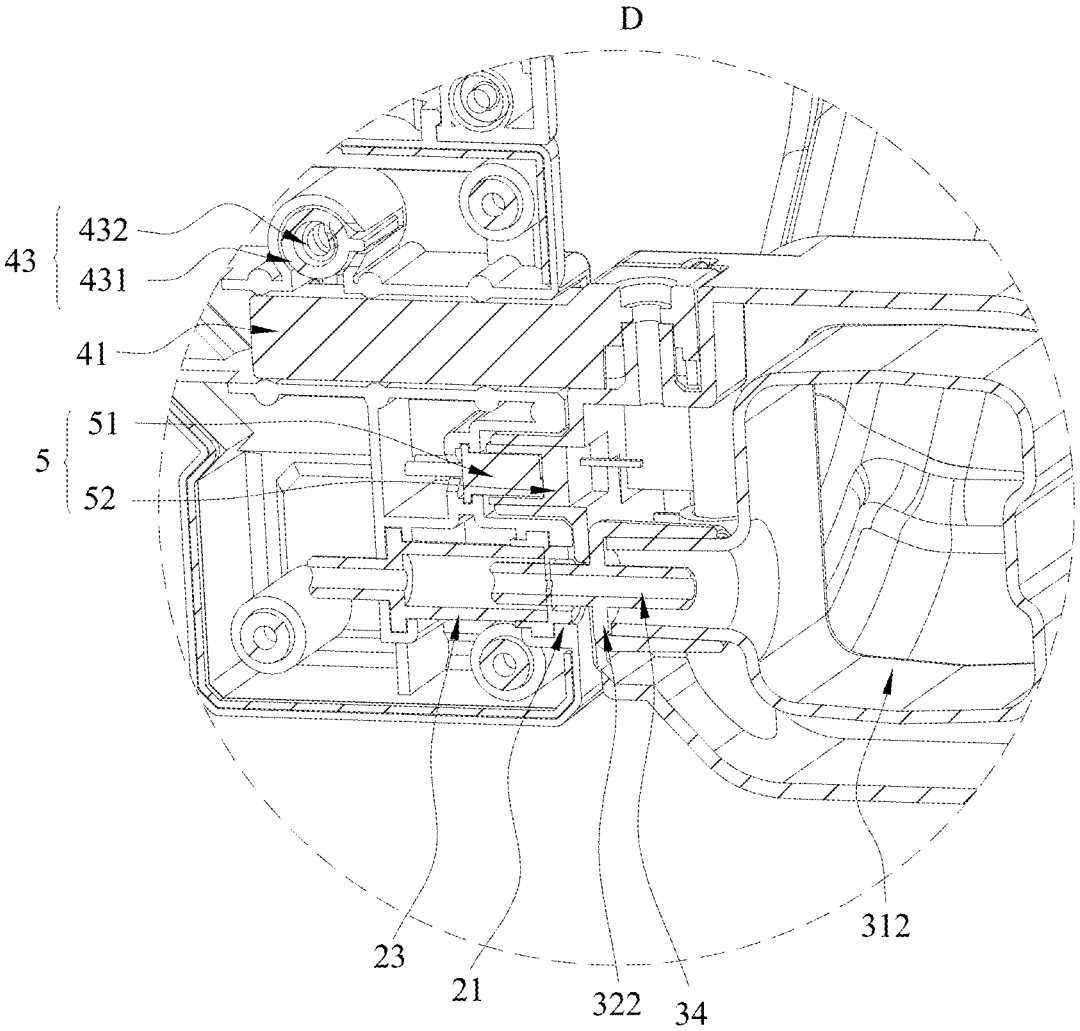
FIG. 10 is an enlarged view of part D of the water gun shown in FIG. 6.

As shown in FIG. 10, in some embodiments of the water gun 10, the reset clamping member 43 includes a reset member 431 and an elastic member 432. The reset member 431 is slidably disposed within the plug-in hole 42, and the elastic member 432 is in driving connection with the reset member 431. The reset member 431 is configured to provide a force that drives the reset member 431 to do reset sliding, so that the reset member 431 is movably clamped to the plug-in member 41.

It can be understood that in this embodiment, the sliding action of the reset member 431 drives a snap-in portion 4311 and a snap-in slot 411 on the plug-in member 41 to form detachable clamping fit, thus ensuring stable connection between the storage device 3 and the gun body 1. When disassembling is required, the reset member 431 can overcome an elastic force of the elastic member 432 and slide under an external force, so that the snap-in portion 4311 is detached from the snap-in slot 411 to achieve quick separation.

A continuous reset force is provided for the reset member 431 through the elastic member 432. When the plug-in member 41 is plugged into the plug-in hole 42, the elastic member 432 presses the snap-in portion 4311 into the snap-in slot 411 through the reset member 431, to maintain stability of connection. After the reset member 431 is released, the elastic member 432 can also be released, so that the elastic force of the elastic member 432 can assist in restoring the reset member 431 to its initial position for next mating.

As shown in FIG. 7 to FIG. 10, in some embodiments of the water gun 10, the plug-in hole 42 is located inside the first mating position 11, and the plug-in member 41 is fixedly disposed within the second mating position 321.

The reset member 431 is slidably arranged on the gun body 1. A snap-fit portion 4311 is arranged on the reset member 431. A snap-in slot 411 is formed in the plug-in member 41. The snap-fit portion 4311 is configured to be detachably plugged into the snap-in slot 411 under driving of the reset member 431.

It can be understood that when the plug-in member 41 is plugged into the plug-in hole 42 to a preset position, the reset member 431 slides under the driving of the elastic member 432, so that the snap-in portion 4311 is embedded into the snap-in slot 411 to form a limitation, so as to prevent the storage device 3 from accidentally falling off. During removal, a user applies an external force to push the reset member 431 (to overcome the elastic force of the elastic member 432), so that the snap-in portion 4311 exits the snap-in slot 411, and the plug-in member 41 can be pulled out from the plug-in hole 42, to complete the separation.

Figure 5:
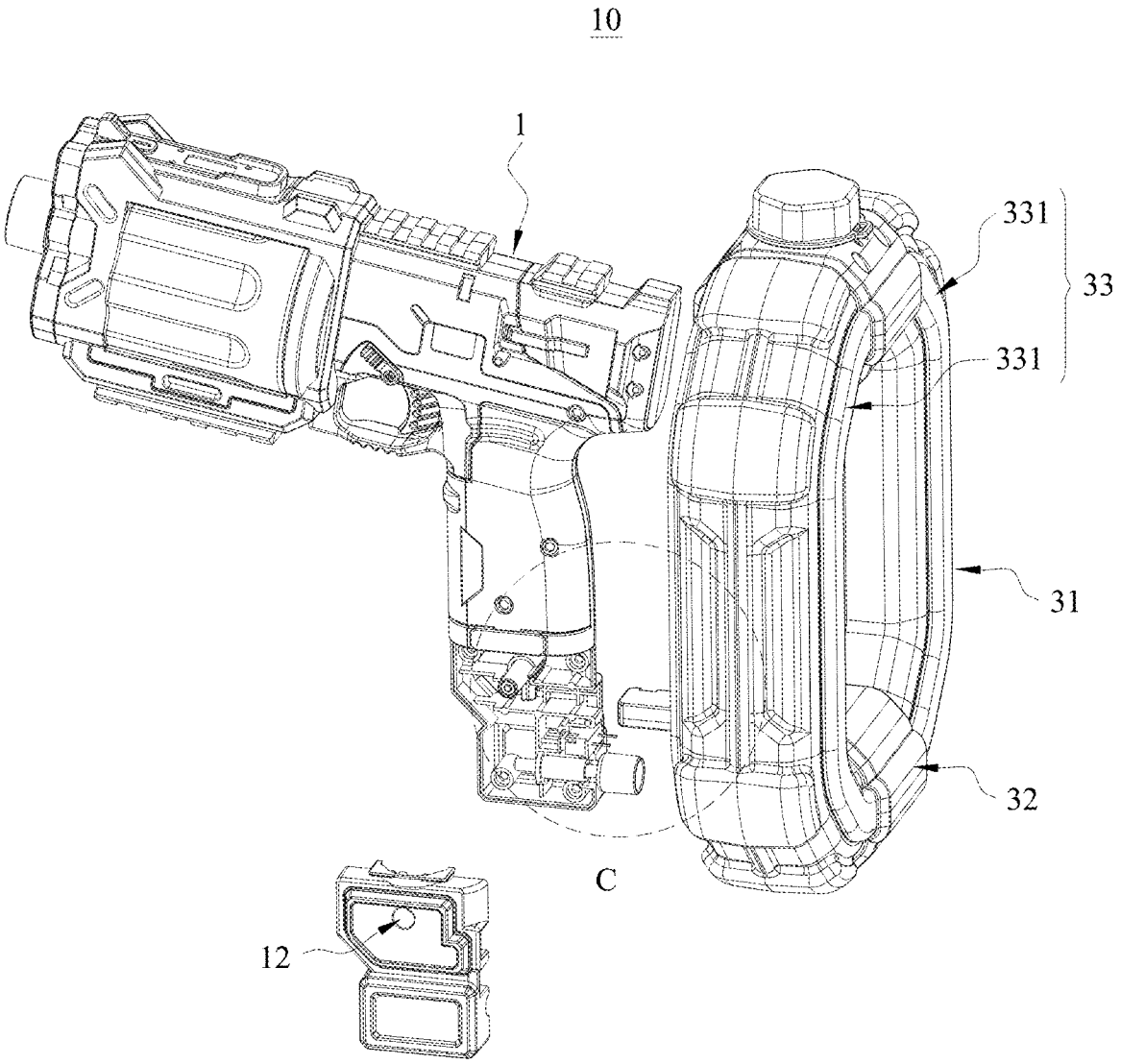
FIG. 5 is a schematic diagram of an internal structure of the water gun shown in FIG. 3.

As shown in FIG. 1 and FIG. 5, in some embodiments of the water gun 10, a clearance hole 12 is further formed in the gun body 1. An end portion of the reset member 431 is arranged to pass through the clearance hole 12 and is exposed from an outer surface of the gun body 1.

It can be understood that the clearance hole 12 is configured to provide a movement space for the reset member 431, so that the end portion of the reset member 431 is arranged to pass through the clearance hole 12 and is exposed from the outer surface of the gun body 1. Thus, the user can directly apply the external force to the reset member 431 (by for example pressing or sliding) through the exposed end portion, thereby driving the reset member 431 to overcome the elastic force of the elastic member 432 and slide, achieving the separation of the snap-in portion 4311 from the snap-in slot 411, and quickly removing the storage device 3. The clearance hole 12 also plays a role in limiting a sliding stroke of the reset member 431, to prevent the reset member 431 from shifting in a sliding process.

In some embodiments of the water gun 10, the first conductive component 51 includes a conductive plug. The second conductive component 52 includes a conductive socket. The conductive plug is in detachable plug-in fit with the conductive socket.

It can be understood that when the first mating position 11 cooperates with the second mating position 321, the conductive plug is plugged into the conductive socket to form electrical connection, thus electrically connecting the circuit of the gun body 1 to the circuit of the storage device 3. The plug-in connection used in this embodiment enables synchronous completion of circuit mating and mechanical mating, without an additional wiring step. By using the content of this embodiment, the circuit can be automatically switched on or switched off during the mounting and removal of the storage device 3, without additional operations.

Figure 7:
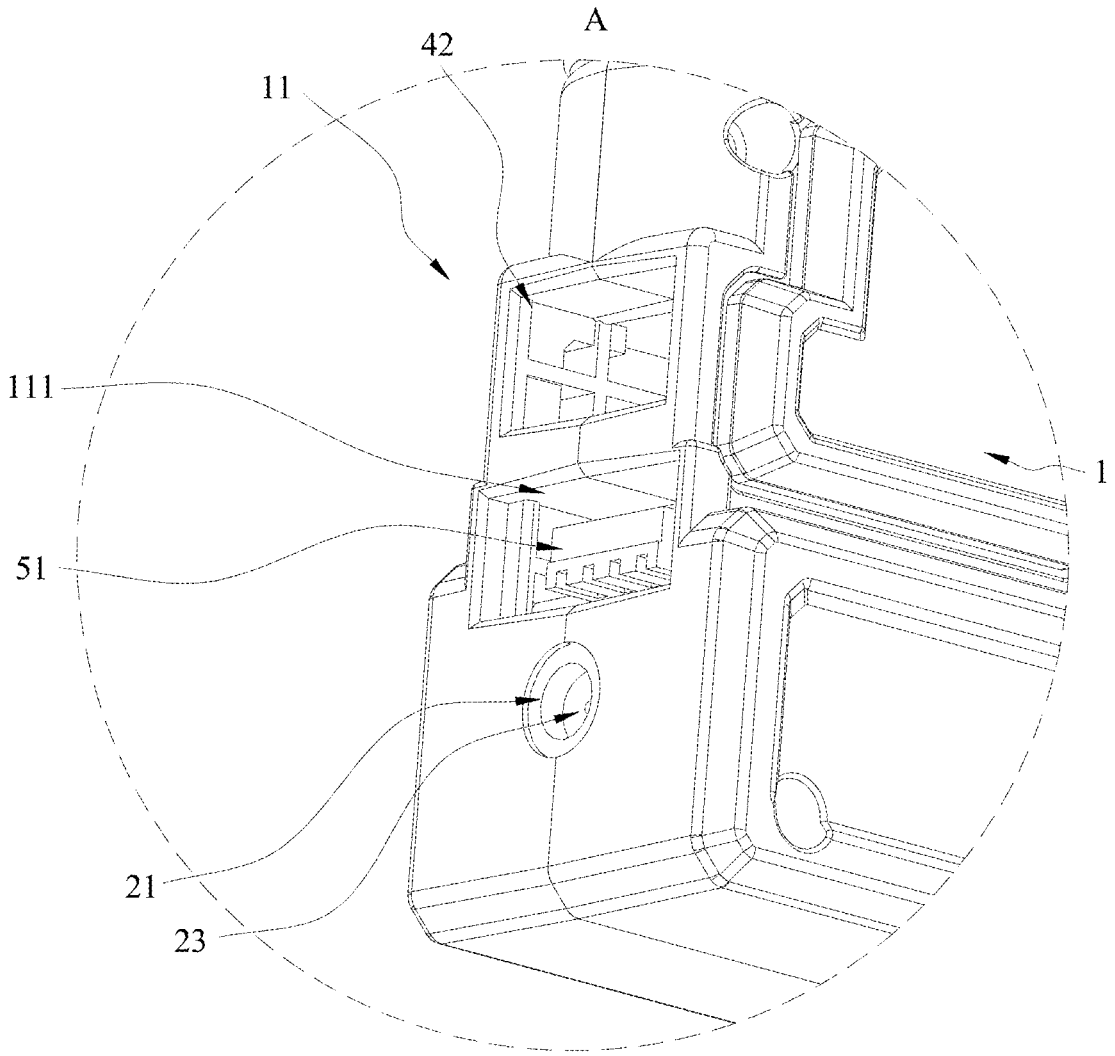
FIG. 7 is an enlarged view of part A of the water gun shown in FIG. 3.
Figure 8:
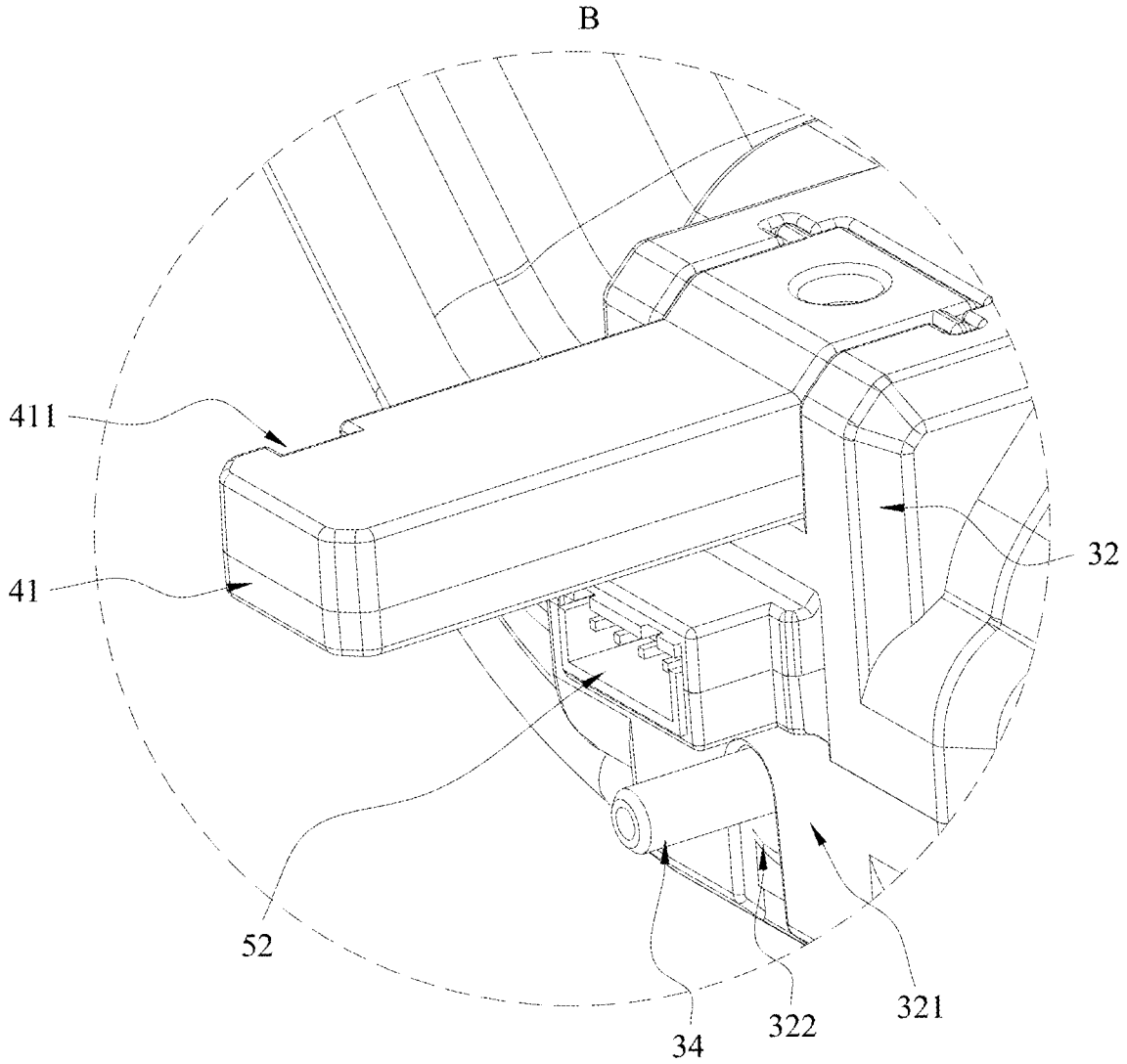
FIG. 8 is an enlarged view of part B of the water gun shown in FIG. 4.
Figure 9:
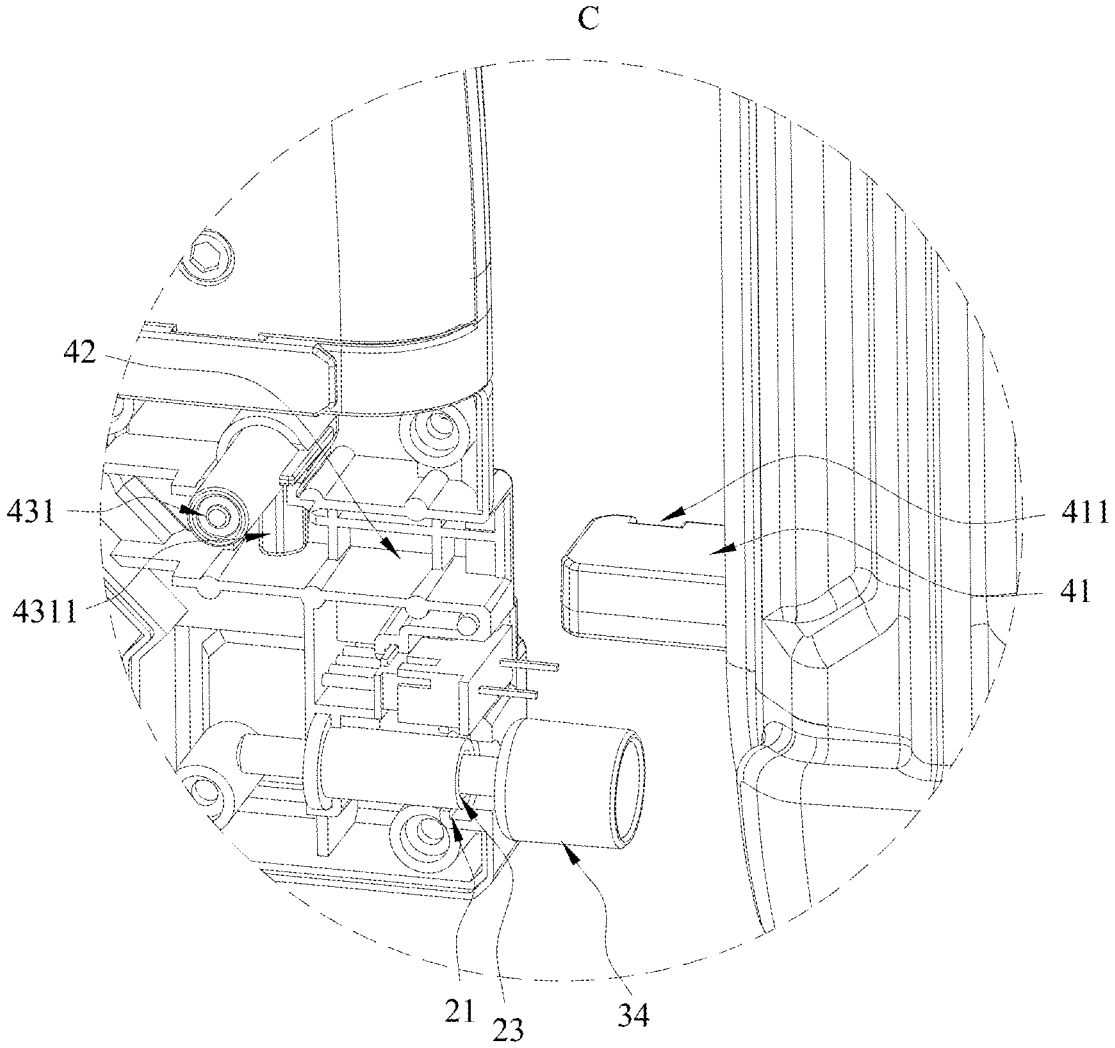
FIG. 9 is an enlarged view of part C of the water gun shown in FIG. 5.

In some other embodiments of the water gun 10, as shown in FIG. 7, FIG. 8, and FIG. 10, the first conductive component 51 includes a conductive socket. The second conductive component 52 includes a conductive plug. The conductive plug is in detachable plug-in fit with the conductive socket.

It can be understood that in this embodiment, the first conductive component 51 is configured as a conductive socket, and the second conductive component 52 is configured as a conductive plug. They have the consistent functions with the structures in the foregoing embodiment, but only exchange their positions. A guiding effect of the conductive socket on the conductive plug enhances mating precision. It is suitable for design requirements of different structural layouts.

As shown in FIG. 7, in some embodiments of the water gun 10, a plug-in slot 111 is formed in the first mating position 11. The first conductive component 51 is disposed within the plug-in slot 111. The second conductive component 52 is detachably plugged into the plug-in slot 111.

It can be understood that the plug-in slot 111 is configured to accommodate the first conductive component 51 and provide guidance and limitation for the plugging of the second conductive component 52. Specifically, the plug-in slot 111 guides the second conductive component 52 to be aligned with the first conductive component 51 through a contour of a slot wall, thus ensuring accurate contact and electrical connection between the conductive components. In addition, the plug-in slot 111 can also prevent external dust or foreign matters from affecting the first conductive component 51, thus ensuring conductivity.

Figure 4:
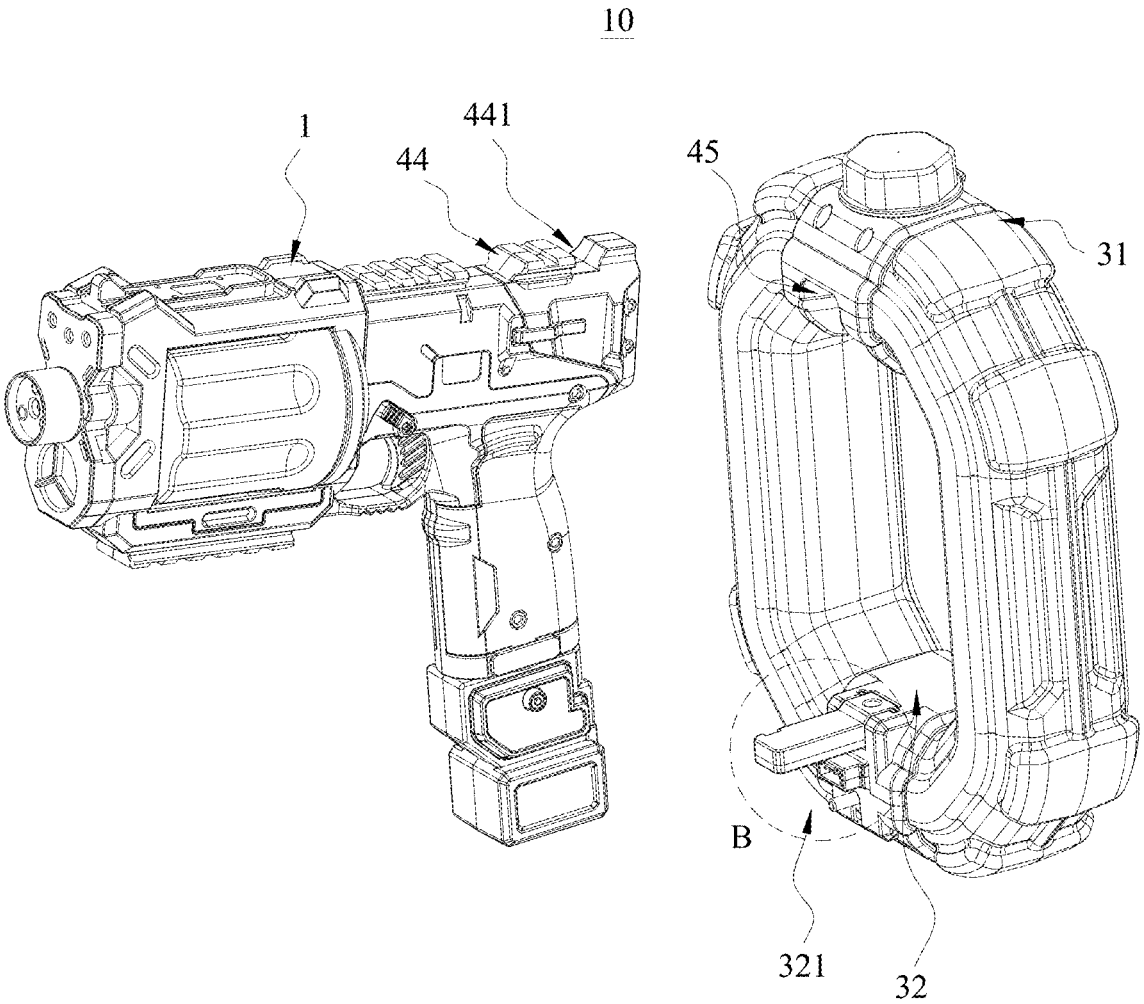
FIG. 4 is an exploded view of a water gun in some other embodiments of the present disclosure.

As shown in FIG. 4, in some embodiments of the water gun 10, the storage device 3 includes a storage member 31, a fixed ring 32, and a power source (not shown). The storage cavity 312 is provided on the storage member 31. The fixed ring 32 is arranged on the storage member 31. The second mating position 321 is arranged on the fixed ring 32. The power source is electrically connected to the second conductive component 52.

It can be understood that the storage member 31 serves as a storage carrier for the object to be shot. A structural composition, volume, and shape of the storage cavity 312 of the storage member 31 are set based on characteristics of the object to be shot (such as a soft dart, a water bullet, liquid) to ensure that the object to be shot can be stably stored and smoothly outputted.

By the arrangement of the fixed ring 32, the weight of the storage member 31 can be uniformly transferred to the gun body 1 through the fixed ring 32, thus avoiding local stress concentration and enhancing durability of the product.

The power source (not shown in the figure) is configured to supply power to the shooting device 2, indicator lights, and other electrical elements on the gun body 1 through the conductive device 5.

As shown in FIG. 5, in some embodiments of the water gun 10, the storage device 3 includes a storage member 31, a fixed ring 32, and an electrical element 33. The storage cavity 312 is provided on the storage member 31. The fixed ring 32 is arranged on the storage member 31. The second mating position 321 is arranged on the fixed ring 32. The electrical element 33 is electrically connected to the second conductive component 52.

It can be understood that in this embodiment, the electrical element 33 is electrically connected to the second conductive component 52, so that the electrical element 33 can obtain power through the circuit on the gun body 1, and can achieve various other functions such as lighting, a sound effect, or vibration.

As shown in FIG. 5, FIG. 6, FIG. 11, and FIG. 12, in some embodiments of the water gun 10, the storage member 31 includes an annular water tank 311, and the fixed ring 32 sleeves the annular water tank 311.

The storage device 3 further includes a liquid output head 34. The shooting device 2 includes a liquid receiving head 23. The liquid output head 34 is arranged at the output end 322, and the liquid receiving head 23 is communicated with the annular water tank 311. The liquid receiving head 23 is arranged at the shooting end 22, and the liquid receiving head 23 is communicated with the shooting end 22. The liquid output head 34 is configured to be mated and electrically connected with the liquid receiving head 23 under driving of the annular water tank 311.

It can be understood that the annular water tank 311 provides a storage space for a liquid object to be shot (such as water). An annular structure of the annular water tank 311 can balance the center of gravity of the storage device 3, to avoid the impact on holding due to the offset of the center of gravity of the water gun 10. When the storage device 3 is mated with the gun body 1, the liquid output head 34 is plugged into the liquid receiving head 23 to form a sealed flow channel, so that the liquid inside the annular water tank 311 can be stably supplied to the shooting end 22 through the liquid output head 34 and the liquid receiving head 23, thus achieving the liquid shooting function.

As shown in FIG. 5, in some embodiments of the water gun 10, the electrical element 33 includes two light-emitting elements 331. The light-emitting elements 331 are configured to emit light when electrified.

Figure 11:
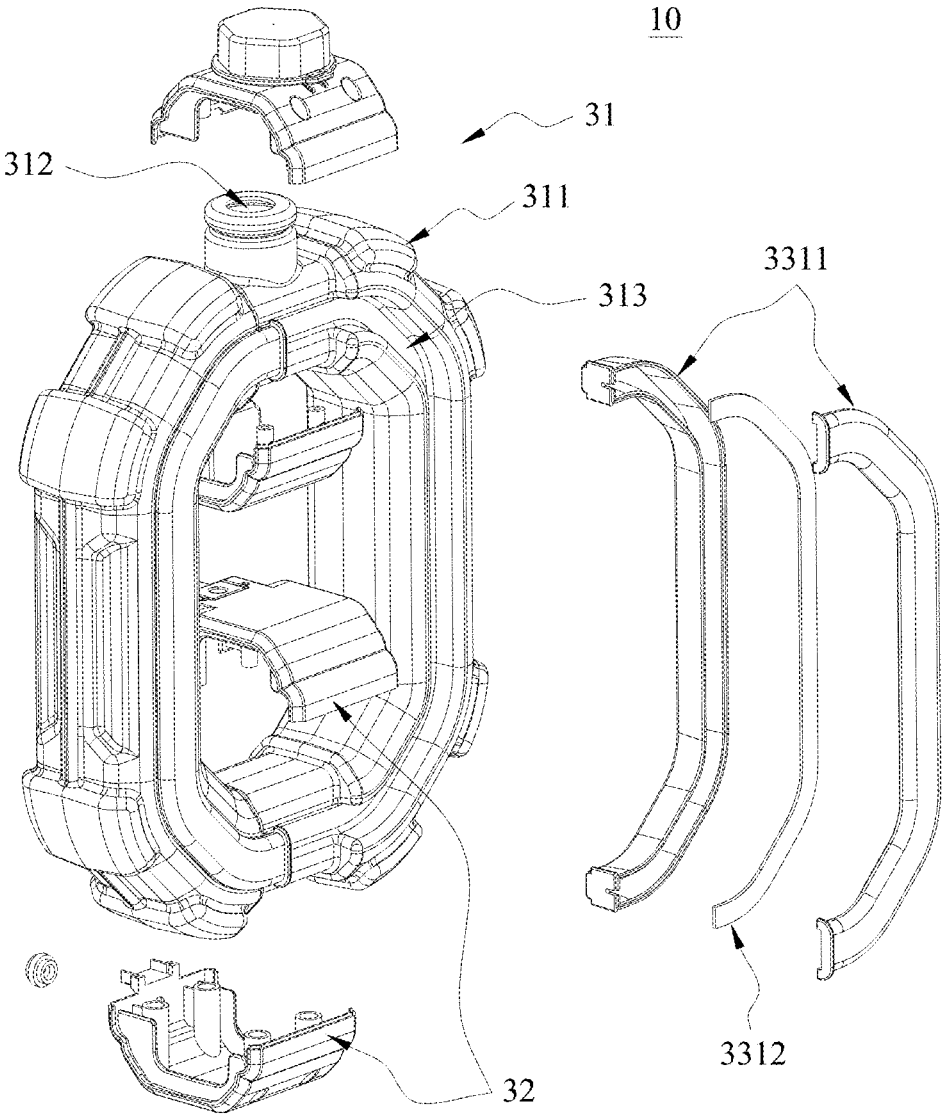
FIG. 11 is a schematic diagram of partial structures of a water gun in some embodiments of the present disclosure.
Figure 12:
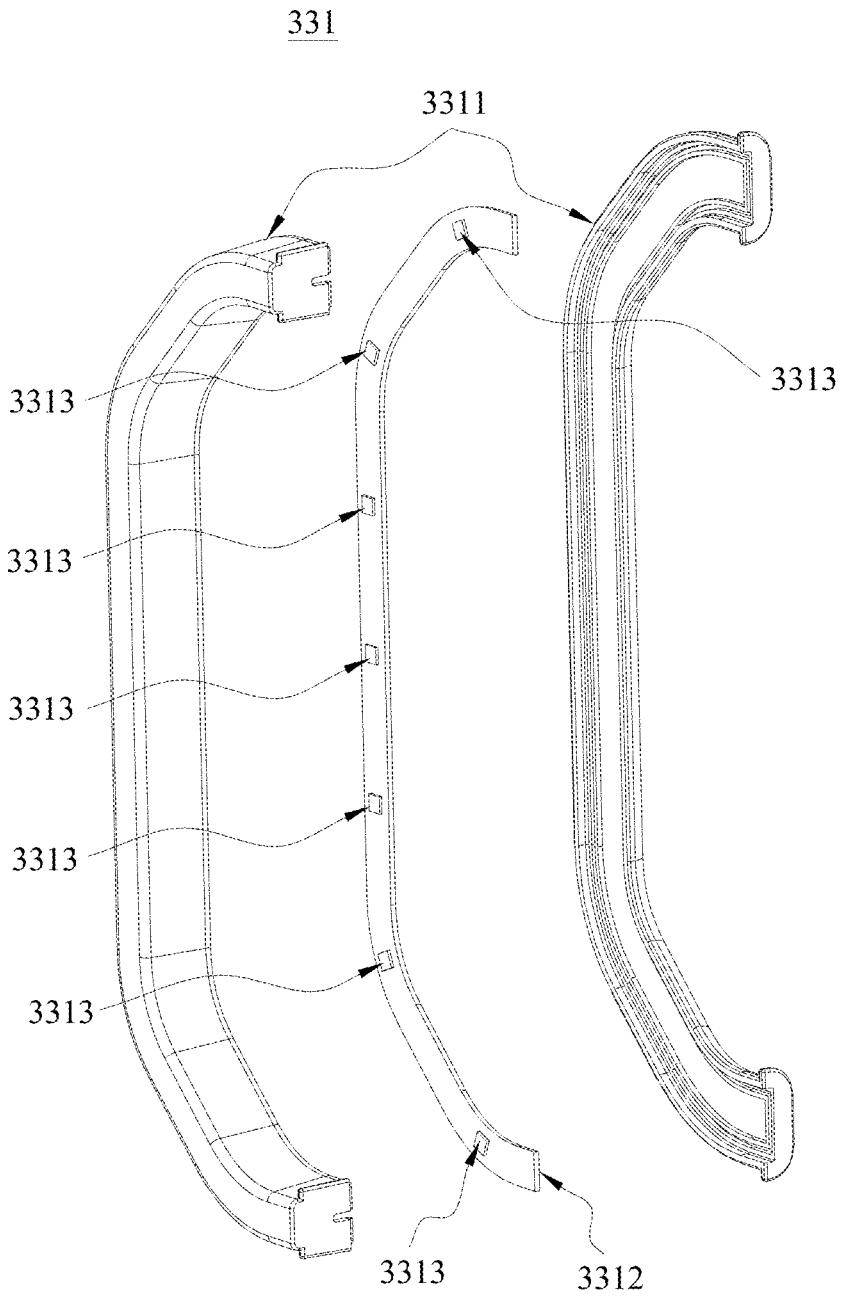
FIG. 12 is an exploded diagram of a light-emitting element in some embodiments of the present disclosure.

As shown in FIG. 11 and FIG. 12, each light-emitting element 331 includes a profiled cylindrical shell 3311, a light-emitting circuit board 3312 disposed within the profiled cylindrical shell 3311, and a plurality of LEDs 3313 arranged on the light-emitting circuit board 3312. The two profiled cylindrical shells 3311 are symmetrically arranged on the annular water tank 311. The two light-emitting circuit boards 3312 are electrically connected to the second conductive components 52.

It can be understood that the profiled cylindrical shell 3311 is configured to protect the light-emitting circuit board 3312 and the LEDs 3313. Due to the profiled contour, after the profiled cylindrical shell 3311 is assembled onto the annular water tank 311, formation of an excessively large protrusion can be avoided. The LEDs 3313 can be configured to achieve flickering, a normally-on state, flowing light, and other lighting effects under the control of the light-emitting circuit board 3312, thus enhancing visual feedback of the water gun 10. Two light-emitting elements 331 are symmetrically arranged on the annular water tank 311, and can form a uniform lighting or ambient lighting effect on the annular water tank 311.

As shown in FIG. 11 and FIG. 12, in some embodiments of the water gun 10, at least one profiled slot 313 is formed in the storage member 31. Each profiled slot 313 is configured to accommodate the electrical element 33. An appearance contour of the electrical element 33 matches a contour of a slot wall of each profiled slot 313.

It can be understood that each profiled slot 313 is configured to locate and fix the electrical element 33. The contour of the slot wall of each profiled slot 313 completely adapts to the shape of the electrical element 33. This can enhance tightness of fit between the electrical element 33 and the storage member 31, and can also avoid formation of an excessively large protrusion of the electrical element 33 on a surface of the storage member 31, thus enhancing surface flatness.

Figure 6:
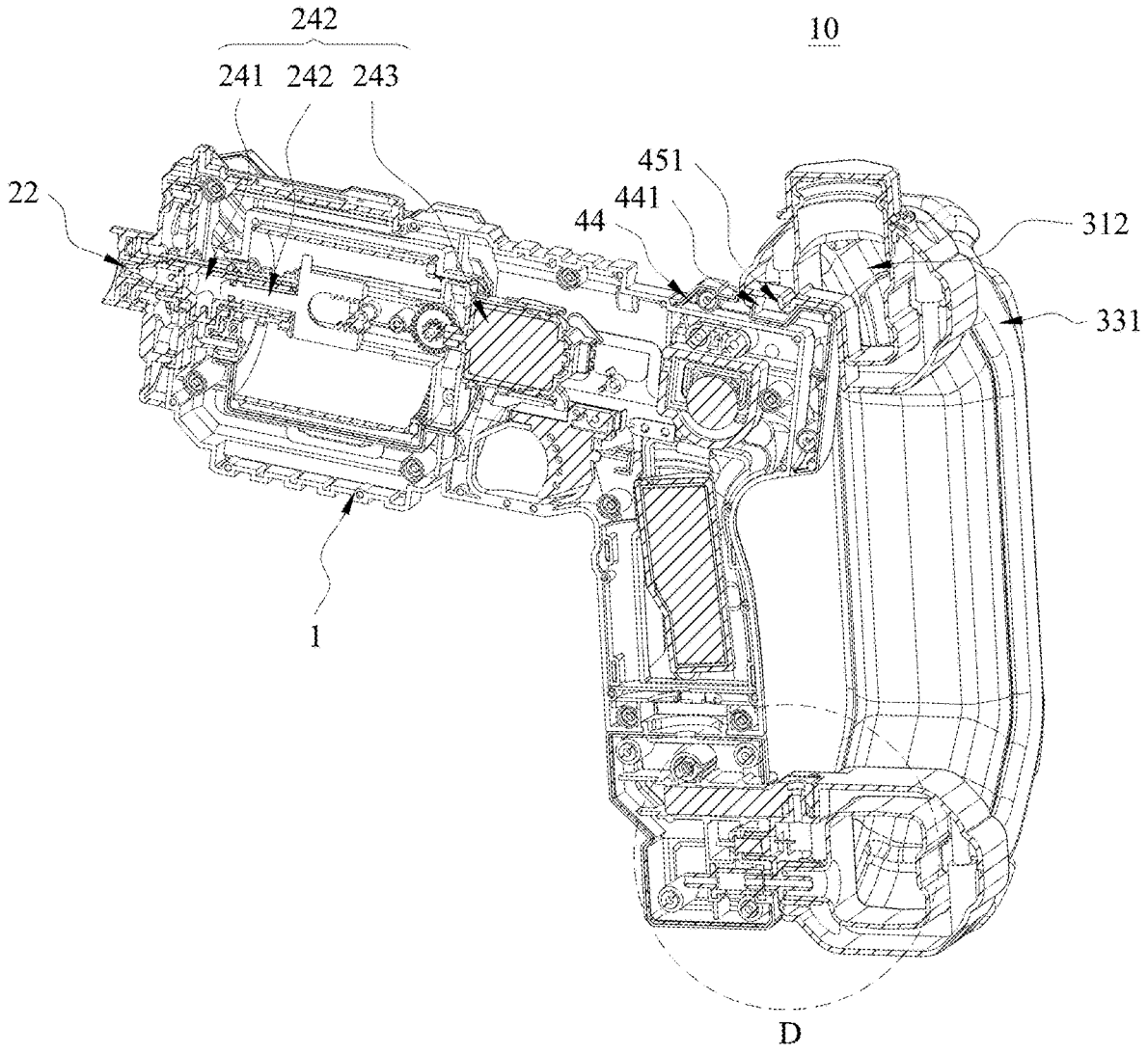
FIG. 6 is a schematic diagram of an internal structure of the water gun shown in FIG. 1.

As shown in FIG. 4 and FIG. 6, in some embodiments of the water gun 10, the mating device 4 further includes a first connector 44 and a second connector slot 45. The first connector 44 is arranged on the gun body 1. An anti-loosening slot 441 is formed in the first connector 44. The second connector slot 45 is arranged on the storage device 3. An anti-loosening protrusion 451 is disposed within the second connector slot 45.

When the first connector 44 is detachably plugged into the second connector slot 45, the anti-loosening protrusion 451 is movably clamped into the anti-loosening slot 441.

It can be understood that the first connector 44 is arranged on the gun body 1, and the second connector slot 45 is provided in the storage device 3. The first connector and the second connector slot are in plug-and-pull fit to achieve auxiliary fixation. When the first connector 44 is plugged into the second connector slot 45, the anti-loosening protrusion 451 is snapped into the anti-loosening slot 441, thus forming a reliable limitation.

It should be noted that combining the content of this embodiment with the content of the plug-in fit between the plug-in member 41 and the plug-in hole 42 can enable the storage device 3 and the gun body 1 to cooperate with each other through two different positions, thus avoiding the gravity from being completely borne by connection positions of the first mating position 11 and the second mating position 321, preventing damage to the conductive device 5 and other plug-in structures due to excessive load bearing, and enhancing the durability of the product.

Specifically, in some embodiments, the shooting device 2 includes a liquid shooting mechanism 24. The liquid shooting mechanism 24 includes a cylinder 241, a piston 242, and a motor 243. The cylinder 241 is arranged on the gun body 1. The piston 242 is slidably disposed within the cylinder 241. The motor 243 is in driving connection with the piston 242.

It can be understood that when the motor 243 is electrified to operate, the piston 242 is driven to move inside the cylinder 241, so that the cylinder 241 can pump the liquid from the receiving end 21 and shoot the absorbed liquid through the shooting end 22, thus achieving pressurized shooting of the liquid.

The present disclosure has the following beneficial effects:

A water gun is provided. On the water gun, when a first mating position and a second mating position are in alignment fit, a plug-in member is detachably plugged into a plug-in hole, so that a reset clamping member is movably clamped to the plug-in member, thus achieving quick assembling and disassembling of a storage device and a gun body, and enhancing disassembling convenience.

Furthermore, when the first mating position and the second mating position are in alignment fit, a first conductive component and a second conductive component are also in detachable fit, so that an electrical element or a power source on the storage device can be mated and electrically connected with a circuit on the gun body, thus eliminating an additional circuit mating and assembling step and further simplifying an assembling process.

In addition, when the first mating position and the second mating position are in alignment fit, an output end and a receiving end are also mated and electrically connected with each other, thereby ensuring effective connection between the storage device and the shooting device, that is, an object to be shot inside the storage device can be supplied to a shooting device for shooting through the output end and the receiving end. Thus, while ensuring convenient mounting and removal of the storage device, the object to be shot that is stored inside the storage device can be smoothly delivered to the shooting device, and a shooting function of the water gun is not affected.

The solutions of the present disclosure have been described in more details above with reference to the accompanying drawings. In the foregoing embodiments, the description of each embodiment has respective focuses. For a part that is not described in detail in an embodiment, reference may be made to related descriptions in other embodiments. Those skilled in the art should also be aware that the actions and modules involved in this specification may not be necessary for the present disclosure. Furthermore, it can be understood that the steps in the method of the embodiments of the present disclosure can be sequentially adjusted, merged, and deleted according to actual needs. The modules in the device of the embodiments of the present disclosure can be merged, partitioned, and deleted according to actual needs.

The above has described the various embodiments of the present disclosure. The above explanation is exemplary, not exhaustive, and is not limited to the various embodiments disclosed herein. Many modifications and changes are obvious to those of ordinary skill in the art without deviating from the scope and spirit of the various embodiments described herein. The selection of the terms used herein aims to best explain the principles and practical applications of the various embodiments or improvements to technologies in the market, or to enable other persons of ordinary skill in the art to understand the various embodiments disclosed herein.

What is claimed is:

1. A water gun, comprising:

a gun body provided with a first mating position;

a shooting device having a receiving end and a shooting end, wherein the shooting device is arranged on the gun body; the shooting end is exposed from a surface of the gun body and is communicated with the receiving end; the receiving end is exposed within the first mating position;

a storage device having a storage cavity, a second mating position, and an output end, wherein the output end is exposed within the second mating position and is communicated with the storage cavity;

a mating device comprising a plug-in member, a plug-in hole, and a reset clamping member, wherein one of the plug-in member and the plug-in hole is arranged at the first mating position, and the other one of the plug-in member and the plug-in hole is arranged at the second mating position; the reset clamping member is movably disposed within the plug-in hole; and a conductive device comprising a first conductive component and a second conductive component, wherein the first conductive component is disposed within the first mating position, and the second conductive component is disposed within the second mating position;

when the first mating position and the second mating position are in alignment fit, the first conductive component and the second conductive component are in detachable fit and are communicated with each other; and the plug-in member is detachably plugged into the plug-in hole, so that the reset clamping member is movably clamped to the plug-in member, thereby electrically connecting the output end with the receiving end;

wherein the storage device comprises a storage member, a fixed ring, and an electrical element;

the storage cavity is provided on the storage member; the fixed ring is arranged on the storage member;

the second mating position is arranged on the fixed ring; and the electrical element is electrically connected to the second conductive component.

2. The water gun according to claim 1, wherein the reset clamping member comprises a reset member and an elastic member; the reset member is slidably disposed within the plug-in hole; the elastic member is in driving connection with the reset member; and the reset member is configured to provide a force that drives the reset member to do reset sliding, so that the reset member is movably clamped to the plug-in member.

3. The water gun according to claim 2, wherein the plug-in hole is located inside the first mating position, and the plug-in member is fixedly disposed within the second mating position;

the reset member is slidably arranged on the gun body; a snap-fit portion is arranged on the reset member; a snap-in slot is formed in the plug-in member; and the snap-fit portion is configured to be detachably plugged into the snap-in slot under driving of the reset member.

4. The water gun according to claim 3, wherein a clearance hole is further formed in the gun body; and an end portion of the reset member is arranged to pass through the clearance hole and is exposed from an outer surface of the gun body.

5. The water gun according to claim 1, wherein the first conductive component comprises a conductive plug; the second conductive component comprises a conductive socket; the conductive plug is in detachable plug-in fit with the conductive socket; or the first conductive component comprises a conductive socket; the second conductive component comprises a conductive plug; and the conductive plug is in detachable plug-in fit with the conductive socket.

6. The water gun according to claim 1, wherein a plug-in slot is formed in the first mating position; the first conductive component is disposed within the plug-in slot; the second conductive component is detachably plugged into the plug-in slot; and/or the storage device comprises a storage member, a fixed ring, and a power source; the storage cavity is provided on the storage member; the fixed ring is arranged on the storage member; the second mating position is arranged on the fixed ring; and the power source is electrically connected to the second conductive component.

7. The water gun according to claim 1, wherein the storage member comprises an annular water tank; the fixed ring sleeves the annular water tank;

the storage device further comprises a liquid output head; the shooting device comprises a liquid receiving head; the liquid output head is arranged at the output end, and the liquid receiving head is communicated with the annular water tank; the liquid receiving head is arranged at the shooting end, and the liquid receiving head is communicated with the shooting end; and the liquid output head is configured to be mated and electrically connected with the liquid receiving head under driving of the annular water tank.

8. The water gun according to claim 7, wherein the electrical element comprises two light-emitting elements; each light-emitting element comprises a profiled cylindrical shell, a light-emitting circuit board disposed within the profiled cylindrical shell, and a plurality of light-emitting diodes (LEDs) arranged on the light-emitting circuit board; the two profiled cylindrical shells are symmetrically arranged on the annular water tank; the two light-emitting circuit boards are electrically connected to the second conductive components; and/or at least one profiled slot is formed in the storage member; each profiled slot is configured to accommodate the electrical element; and an appearance contour of the electrical element matches a contour of a slot wall of each profiled slot.

9. The water gun according to claim 1, wherein the mating device further comprises a first connector and a second connector slot;

the first connector is arranged on the gun body; an anti-loosening slot is formed in the first connector;

the second connector slot is arranged on the storage device; an anti-loosening protrusion is disposed within the second connector slot; and when the first connector is detachably plugged into the second connector slot, the anti-loosening protrusion is movably clamped into the anti-loosening slot.

* * * * *